US006660155B2

(12) United States Patent
Kim

(10) Patent No.: US 6,660,155 B2
(45) Date of Patent: Dec. 9, 2003

(54) PROCESS OF SURFACE COATING GLASS PANELS

(75) Inventor: Kwang Soon Kim, Seoul (KR)

(73) Assignee: Korea Houghton Corporation, Seoul (KR)

( * ) Notice: Subject to any disclaimer, the term of this patent is extended or adjusted under 35 U.S.C. 154(b) by 162 days.

(21) Appl. No.: 09/999,440

(22) Filed: Nov. 27, 2001

(65) Prior Publication Data

US 2003/0102216 A1 Jun. 5, 2003

(51) Int. Cl.[7] ..... C25D 11/00

(52) U.S. Cl. ..... 205/317; 205/229; 205/224; 205/205; 205/181; 205/182; 204/488

(58) Field of Search ..... 205/317, 229, 205/224, 205, 182, 181; 204/488

(56) References Cited

U.S. PATENT DOCUMENTS 4,869,798 A * 9/1989 Kamps et al. ..... 204/224 R
5,227,206 A * 7/1993 Bachli ..... 428/34

* cited by examiner

*Primary Examiner*—Kishor Mayekar
(74) *Attorney, Agent, or Firm*—Roth & Goldman, P.A.

(57) ABSTRACT

A process of coating the surface of articles made of glass pieces assembled in a came to minimize breakage of glass during application and hardening of the coating The process includes the steps of preprocessing the article, electrodepositing the coating on the article, and hardening the electrodeposited and coated article glass step-by-step.

4 Claims, No Drawings

PROCESS OF SURFACE COATING GLASS PANELS

BACKGROUND OF THE INVENTION

1. Field of the Invention

The present invention relates to the manufacture of glass articles, particularly panels comprised of a metal frame holding individual pieces of panes of curved or beveled glass, such as works of art, and the prevention of glass breakage and solder or resin flow during electrodeposition and heat treatment of protective coatings on the metal frame or came and glass pieces assembled therein.

2. Description of the Background Art

Works of art are often made of a number of flat, curved or beveled glass pieces or panes which are mounted in a brass came in which the joints of the came are soldered or welded with lead. The brass came typically discolors over time and, in order to overcome the discoloration problem, a nickel coating is applied on the surface of the brass came to obtain a glossy surface. Thereafter, a transparent resin coating is applied, and the coated surface may be painted to prevent discoloring. In this regard, various techniques for processing the surfaces are disclosed in Korean Patent application No. 10-1999-0000897. However, the glass pieces or panes are easily broken during known electrodeposition coating and heat hardening processes.

SUMMARY OF THE INVENTION

Accordingly, it is an object of the present invention to provide a process of surface coating glass panels which overcomes the problems encountered in the conventional art.

In order to achieve the above object, there is provided a surface treatment process which includes the steps of pre-processing the assembled article of came and glass pieces, electrodepositing a coating and paint, and stepwise hardening the coated and painted article.

DETAILED DESCRIPTION OF THE PREFERRED EMBODIMENTS

The surface treatment method broadly involves the following steps.

(A) Pre-processing of the assembled came and glass pieces;

(B) Electrodeposition coating of the assembled pieces and came; and (C) Step by step heat hardening of the coated came and glass.

The individual steps will each be explained in detail.

(A) Pre-Processing

The preprocessing involves removing non-conductive foreign substances which may adhere to the glass surfaces and is implemented by an ultrasonic wave treatment, electrolytic and fat removal.

Fat Removal by Ultrasonic Wave Treatment

The assembled article comprised of came and glass pieces is immersed in a solvent having a temperature of 50~80° F. and is subjected to application of ultrasonic waves for 1~5 minutes. Foreign substances such as fat attached in the grooves or on the surfaces of the article are removed by the ultrasonic wave treatment. The solvent may comprise a water-soluble solvent containing 3~5 W % sodium soda, 2~3 W % phosphoric acid, 1~2 W % caustic soda, and 0.1~3.0 W % of an interfacial activator in an organic solvent such as trichloroethylene, benzene, toluene, xylene or the like.

Fat Removal by Electrolytic Treatment

The above ultrasonic wave processed article is then immersed in a water soluble solvent containing 0.2~0.5 W % caustic soda, 2~3 W % phosphoric acid, 1~1.5 W % sodium carbonate, and 0.2~0.05 W % of an interfacial activator. A cathode of nickel, stainless steel, aluminum or brass may be used, and a zinc and zinc die casting may be used for the anode, and the article is electrolyticly processed at a current density of 5~10 Am/dm2 for 30~60 seconds. This results in oxidation of the fat components by oxygen gas at the anode, and removal of floating components by hydrogen gas at the cathode.

Acid Treatment

Even after alkali fat removal and electrolytic fat removal pre-processing steps have been performed, an oxide film or undissolved coating may still remain on the non-conductive surfaces which is detrimental to the subsequent coating steps which take place. Therefore, 5~20 W % sulfuric acid or hydrochloric acid are added to remove the remaining film or coating. At this time, the immersion time is 30~60 seconds.

B) Electrodeposition Steps

Copper Coating

A copper coating is first provided as a substrate coating for a nickel coating to enhance a smoothness and removing cracks. The copper is electrodeposited in an aqueous bath containing 15~30 W % copper and 4~10 W % sulpheric acid for 5~20 minutes based on a cathode current density of 1~10 Am/dm2, an anode current density of 0.5~5 Am/dm2.

Nickel Coating

A nickel coating is then applied to achieve a glossy surface of uniform thickness on the article. The nickel surface is electrodeposited at a cathode current density of 1~10 Am/dm2 in a water solution containing 24~45 W % sulphuric acid, 3.8~6 W % nickel chloride, and 3~5 W % boron. At this time, the anode is the nickel plate, and the nickel coating operation is performed by a blowing method in which air is blown from the lower portion of the working place for thereby flowing the liquid.

Resin Paint Coating

The preprocessed came and glass pieces are ultrasonically rinsed for 1~5 minutes. The rinsed article is then connected with the anode in the electrodeposition container, and a current having a certain density is applied thereto to electrodeposit a protective coating such as a variable 14–15 W % acryloyl resin type albrifin resin (England, Atotech, Co.), and 0.002 W % paint. Any electrodeposition apparatus may be used to provide a current density of 40~50 Am/dm2 for 30~180 seconds.

(C) Step-by-Step Heat Hardening

The hardening process of the present invention is directed to preventing flow of resin and lead solder and the glass from being broken when it is dried at a high temperature. The hardening process of the present invention includes the following steps.

a. The electrodespotion processed article is dried for 35~50 minutes at 45~55° in a pre-drying step.

b. The pre-dried article is heated to a temperature of 130~145° for 40~60 minutes to prevent the flow of resin and lead.

c. The temperature increased article is dried for 90~150 minutes.

d. The dried article is gradually cooled for to prevent the glass from being broken due to the quick cooling.

The drying temperature of step (b) is significantly lower than the conventional drying temperature of about 170°.

The following Examples of the present invention will explain the invention in more detail.

EXAMPLE 1

A small sized beveled glass panel of 8 cm×30 cm is ultrasonically wave cleaned for 3 minutes at 60° in one liter of water containing 30 g of sodium carbonate, 20 g of phosphoric acid, 7 g of caustic soda, 3 g of interfacial activator (fat removing material; Shinpoong Metal, fabrication no. 1090, Korea). The ultrasonic wave-processed panel is then connected with the cathode and is immersed in an alkali water solution containing 3 g caustic soda, 10 g phosphoric acid, 10 g sodium carbonate soda, 0.5 g interfacial activator (fat removing material; Shinpoong Metal, fabrication no. 1090, Korea) and is applied with power for 1 minute at an electrolytic density of 10 A/dm2.

Next, the panel is inserted into a 10% sulfuric acid water solution for 30 seconds, and the panel is connected with the cathode in the water solution of 1 liter of water, 200 g of copper and 100 ml of sulfuric acid and is processed for 25 minutes at 10 A/dm2 for thereby obtaining a brown copper coating.

The preprocessed article is rinsed by water for 3 minutes at a temperature of 50~60°, and a ultrasonic wave is scanned at 30°, and then is rinsed by an air blower for 5 minutes using a pure water of 250,000 Ωcm.

The thusly rinsed article is electrodeposition-processed using an ammonia water in the container of the ester 5 ml to have pH of 7~8.

The electrodeposition paint is a variable acryloyl resin type Albrifin resin (England Atotech. Co.) and is used by 14~16 W % and is emulsified to 1~2 W % using the emulsifying material and mixes a solution Brass group organic distribution paint 0.002 weight % for thereby fabricating a 1-liquid type electrodeposition material. A butyl cellosolve type solvent is used for dissolving the electrodeposition paint.

The electrodeposition of the paint is performed at a voltage 25V, a temperature of the paint solution of 24±1 ° for 1 minute. Thereafter, the resultant material is dried for 20 minutes at 16°. The current density if 45 A/dm2. As a result, a conductive film of a thickness of 4~10 $\mu$ is formed.

The electrodeposition-processed article is dried at 45~55° for 35~50 minutes. The pre-dried article is heated to 130~145° for 40~60 minutes. Next, the temperature increased article is dried for 90~150 minutes. Thereafter, the article is gradually cooled.

A standard physical test is then performed on the coated article. The results of the test are shown in Table 1 in which the results depict the percentages of breakage defects and resin flow in the tested samples.

EXAMPLE 2

In this example, the process is the same as Example 1 except the electrodeposition-processed article is not dried for 35~50 minutes at 45~55° as in Example 1. The results of Example 2 are shown in Table 1.

EXAMPLES 3~7

Examples 3~7 are the same as the Example 1 except for that the pre-dried article temperature is increased to 130~145° for 10, 30, 70, 80 and 130 minutes, respectively, in the hardening process of The Example 1. The results of Examples 3~7 are also shown in Table 1.

TABLE 1

| | Examples | | | | | | |
|---|---|---|---|---|---|---|---|
| | 1 | 2 | 3 | 4 | 5 | 6 | 7 |
| Glass broken | 0.24 | 0.50 | 5.89 | 4.03 | 3.67 | 1.00 | 0.30 |
| Resin flow | 1.26 | 2.32 | 5.45 | 4.34 | 3.01 | 2.22 | 1.34 |

Accordingly, in the present invention, it is possible to fabricate assembled articles comprised of a metal came and glass pieces having a good gloss, anti-chemical and anti-weather properties, in which lead does not flow and glass is not easily broken based on the step-by-step hardening process after the electrodeposition.

As the present invention may be embodied in several forms without departing from the spirit or essential characteristics thereof, it should also be understood that the above-described embodiments do not limit any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A process of surface treating an assembled article of metal and glass, comprising the steps of:

pre-processing the article by ultrasonic cleaning;

electrodepositing a resin paint coating on the cleaned article; and hardening the electrodeposited resin paint coating by pre-drying the article for 35~50 minutes at 45~55°;

increasing the temperature of the dried article to 130~145° for 40~60 minutes;

drying the temperature increased article for 90~150 minutes; and gradually cooling the article.

2. The process of claim 1, wherein said electrodepositing further includes electrodepositing layers of copper, and nickel.

3. The process of claim 2, wherein said resin paint is electrodeposited from a solution of paint containing acryloyl albrifin resin in butyl cellosolve.

4. The process of claim 3, wherein said resin paint is electrodeposited at a current density of 40–50 Am/dm2 for 30–180 seconds.

* * * * *